US008757598B1

(12) United States Patent
Jones

(10) Patent No.: US 8,757,598 B1
(45) Date of Patent: Jun. 24, 2014

(54) HOLLOW CORE POST ANCHOR

(71) Applicant: Bradley Noel Jones, Fairview, TN (US)

(72) Inventor: Bradley Noel Jones, Fairview, TN (US)

( * ) Notice: Subject to any disclaimer, the term of this patent is extended or adjusted under 35 U.S.C. 154(b) by 0 days.

(21) Appl. No.: 13/930,894

(22) Filed: Jun. 28, 2013

(51) Int. Cl.
*E04H 17/00* (2006.01)

(52) U.S. Cl.
USPC ..... 256/65.14; 256/69; 256/70; 256/DIG. 5; 52/298; 52/301; 52/127.2; 248/346.03; 248/523

(58) Field of Classification Search
USPC ..... 52/745.17, 741.15, 295, 297, 296, 52/127.2; 256/65.14, 69, 70, DIG. 5, 256/65.11, 65.12, 59; 248/519, 523, 248/346.01, 346.03, 218.4; 403/248, 252, 403/255, 257, 263
See application file for complete search history.

(56) References Cited

U.S. PATENT DOCUMENTS 5,401,080 A * 3/1995 Wenzel ..... 301/132
5,568,909 A * 10/1996 Timko ..... 248/519
5,660,013 A * 8/1997 Saldarelli et al. ..... 52/296
6,015,139 A * 1/2000 Weber ..... 256/65.14
6,336,620 B1 * 1/2002 Belli ..... 248/519
6,857,808 B1 * 2/2005 Sugimoto et al. ..... 403/41
7,243,473 B2 * 7/2007 Terrels ..... 52/843
7,722,014 B2 * 5/2010 Godwin ..... 256/65.14
7,802,351 B2 * 9/2010 McGinness et al. ..... 29/458
8,141,830 B1 * 3/2012 Hudson ..... 248/220.1
8,365,485 B2 * 2/2013 Reyneveld ..... 52/295

* cited by examiner

*Primary Examiner* — Chi Q Nguyen
(74) *Attorney, Agent, or Firm* — Waddey Patterson; Mark A. Pitchford

(57) ABSTRACT

A hollow core post anchor includes a base plate and a post mounting protrusion. The base plate has two mounting holes adjacent opposing corners of the base plate, and L-shaped stabilizing supports at or adjacent to the other two opposing corners of the base plate. The post mounting protrusion includes a post mounting hole therethrough for receiving a carriage bolt. The two mounting holes in the base plate are each operable to receive a lag screw to secure the base plate and post anchor to a surface (e.g., a concrete pier or foundation). A hollow core post is then positioned on the post mounting protrusion, and securing a carriage bolt through the hollow core post and post mounting hole in the post mounting protrusion secure the hollow core post to the post anchor and thus to the surface.

9 Claims, 5 Drawing Sheets

HOLLOW CORE POST ANCHOR

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to post anchors for use in construction. More particularly, this invention pertains to post anchors for hollow core posts.

A post anchor is used to attach posts (i.e., load bearing framing members that are usually upright) to a surface such as a concrete pier, concrete slab, or wood decking. Generally a post anchor has an upright portion and a base portion. The base portion attaches to the surface, and the upright portion attaches to the post to maintain the bottom of the post in a fixed location with respect to the surface. Higher quality post anchors also serve to bias the post into an upright position or position perpendicular to the surface. Some post anchors have nailing flanges that extend beyond the footprint of the post, requiring trimming to conceal the post anchor. This may also allow the post end to contact a continuous flat surface, retaining water at the seam and promoting rot of the wood and rust of the post anchor. Some post anchors have upright portions that extend outside the footprint of the post. This is problematic when trying to attach framing flat with the outer post face at the post near the surface to which the post anchor is affixed. Further, some post anchors only have a single mounting hole for attaching the post anchor to the surface which reduces the ability of the post anchor to the bias the post into a position perpendicular to the surface and anchor the bottom of the post in place with respect to the surface. It also allows the post and post anchor to rotate about the mounting hole.

Hollow core posts have become more accepted just as all engineered lumber has become more accepted. They can be lighter and stronger than traditional dimensional lumber. However, they also present new challenges such as internal drainage, and their structural integrity deteriorates quicker than traditional solid dimensional lumber due to the decreased material.

BRIEF SUMMARY OF THE INVENTION

In one aspect of the invention, a hollow core post anchor includes a base plate and a post mounting protrusion. The base plate has two mounting holes adjacent opposing corners of the base plate, and L-shaped stabilizing supports at or adjacent to the other two opposing corners of the base plate.

In another aspect of the invention, a post anchor is operable to attach to a hollow core post and a surface. The hollow core post extends along a first longitudinal axis, and a cross-section of the hollow core post perpendicular to the first longitudinal axis has an internal dimension and an external dimension. The post anchor includes a base plate, a post mounting protrusion, a first stabilizing support, and a second stabilizing support. The base plate defines a plane and has a substantially rectangular footprint such that the base plate has 4 corners and 4 sides. The base plate has a first mounting hole therethrough and a second mounting hole therethrough. The first mounting hole is adjacent a first corner of the 4 corners of the base plate, the second mounting hole is adjacent a second corner of the 4 corners of the base plate, and the first corner is opposite the second corner. The post mounting protrusion extends along a second longitudinal axis and is affixed to a first face of the base plate such that the second longitudinal axis is substantially perpendicular to the plane defined by base plate. The first stabilizing support is affixed to the base plate and extends substantially perpendicularly from the first face of the base plate. The second stabilizing support is affixed to the base plate and extends substantially perpendicularly from the first face of the base plate.

In another aspect, a post anchor system includes a surface, a hollow core post, and a post anchor. The hollow core post extends along a first longitudinal axis, and a cross-section of the hollow core post perpendicular to the first longitudinal axis has an internal dimension and an external dimension. The post anchor is operable to attach the hollow core post to the surface. The post anchor includes a base plate, a post mounting protrusion, a first stabilizing support, and a second stabilizing support. The base plate defines a plane and has a substantially rectangular footprint such that the base plate has 4 corners and 4 sides. The base plate has a first mounting hole therethrough and a second mounting hole therethrough. The first mounting hole is adjacent a first corner of the 4 corners of the base plate, the second mounting hole is adjacent a second corner of the 4 corners of the base plate, and the first corner is opposite the second corner. The post mounting protrusion extends along a second longitudinal axis and is affixed to a first face of the base plate such that the second longitudinal axis is substantially perpendicular to the plane defined by base plate. The first stabilizing support is affixed to the base plate and extends substantially perpendicularly from the first face of the base plate. The second stabilizing support is affixed to the base plate and extends substantially perpendicularly from the first face of the base plate.

In another aspect, a method of anchoring a hollow core post to a surface includes drilling a first concrete anchor pilot hole and a second concrete anchor pilot hole into the surface. The first concrete anchor is screwed through a first mounting hole in a base plate of a post anchor into the first concrete anchor pilot hole in the surface. A second concrete anchor is screwed through a second mounting hole in the base plate of the post anchor into the second concrete anchor pilot hole in the surface. At least one countersink recess is bored into the hollow core post to align with a post mounting hole in a post mounting protrusion of the post anchor when an end of the hollow core post is in contact with a first stabilizing support and a second stabilizing support of the post anchor. The hollow core post extends along a first longitudinal axis, and the post mounting protrusion extends along a second longitudinal axis. The hollow core post is positioned on the post mounting protrusion of the post anchor such that the first longitudinal axis is substantially code linear with the second longitudinal axis, and the end of the hollow core post is in contact with the first stabilizing support and the second stabilizing support of the post anchor. A carriage bolt is positioned into the board countersink recess through the post mounting hole in the post mounting protrusion. A nut is tightened onto the carriage bolt to complete the installation. The base plate defined the plane, and the base plate has a substantially rectangular footprint such that the base plate has four corners and four sides. The base plate has a first mounting hole therethrough and a second mounting hole therethrough. First mounting hole is adjacent the first corner of the four corners of the base plate. The second mounting hole is adjacent the second corner of the four corners of the base plate. The first corners opposite the second corner. The post mounting protrusion is affixed to a first face of the base plate, and the second longitudinal axis is substantially perpendicular to the plane defined by the base plate. The first stabilizing support is affixed to the first face of the base plate extends substantially perpendicularly from the plane defined by the base plate. The second stabilizing support is affixed to the first face of the base plate and extends substantially perpendicularly from the plane defined by the base plate.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
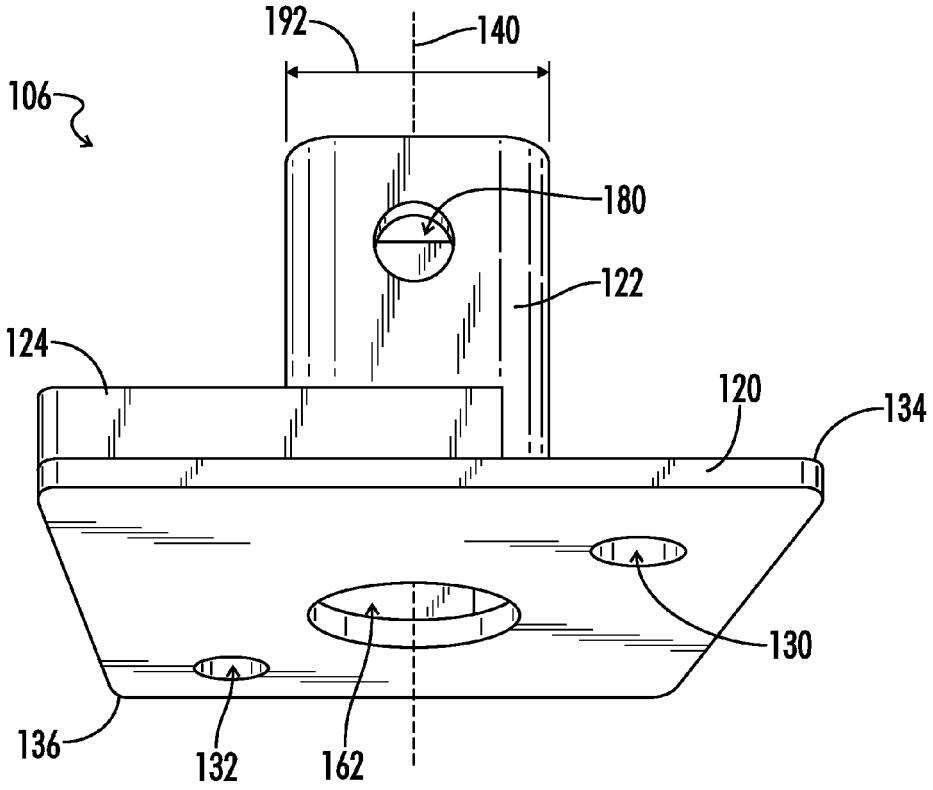
FIG. 1 is a depressed side view of a post anchor.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation as described herein. Vertical, horizontal, top, bottom and other orientation terms are described with respect to this upright position during operation unless otherwise specified. The term when is used to specify orientation, not as a temporal limitation of the claims or apparatus described and claimed herein unless otherwise specified.

Referring to FIGS. 1-5, a post anchor system 100 includes a surface 102, a hollow core post 104, and a post anchor 106. The surface 102 may be a concrete pier, concrete block, concrete slab, wood decking, or some other surface to which the hollow core post 104 is to be anchored. The hollow core post 104 extends along a first longitudinal axis 108. A cross-section (see FIG. 5) of the hollow core post 104 perpendicular to the first longitudinal axis 108 has an internal dimension 110 and an external dimension 112.

Post anchor 106 is operable to attach the hollow core post 104 to the surface 102. The post anchor 106 includes a base plate 120, a post mounting protrusion 122, a first stabilizing support 124, and a second stabilizing support 126. The base plate 120 is substantially planar such that it defines a plane. In one embodiment, the plane is defined by a first face 128 (e.g., a topside) of the post anchor 106. The base plate 120 has a substantially rectangular footprint (i.e., overhead profile when viewed from the top, see FIG. 2) such that the base plate 120 has four corners and four sides. In one embodiment, the footprint of the base plate 120 is substantially square and approximately 3.5"×3.5", 5.5"×5.5", or 7.5"×7.5". The base plate 120 includes a first mounting hole 130 therethrough and a second mounting hole 132 therethrough. First mounting hole 130 is adjacent a first corner 134 of the base plate 120, and the second mounting hole 132 is adjacent a second corner 136 of the four corners of the base plate 120. The first corner 134 is opposite the second corner 136. In one embodiment, the base plate 120 has an exterior dimension 194 along the four edges of the base plate 120 that is approximately the same as the external dimension 112 of the cross-section of the hollow core post 104.

Figure 2:
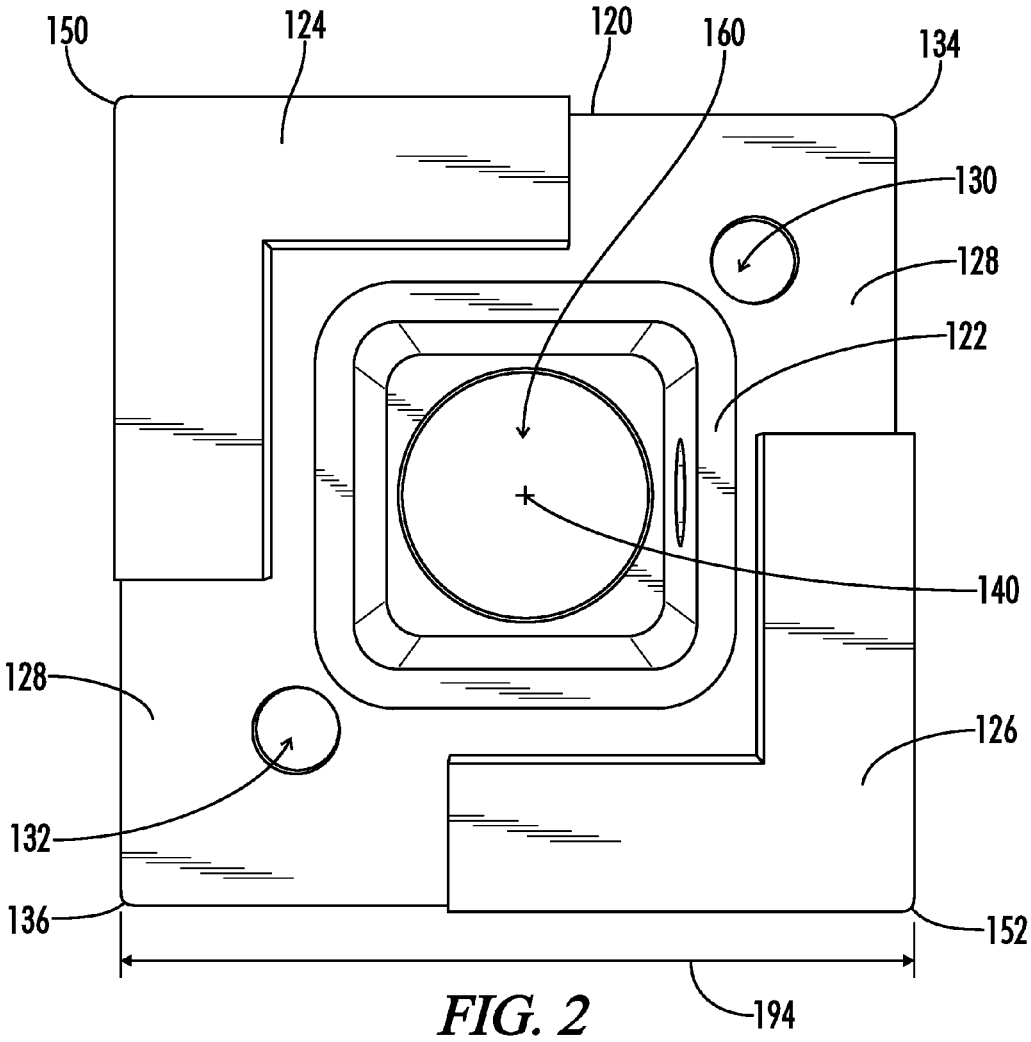
FIG. 2 is an overhead perspective view of a post anchor.
Figure 3:
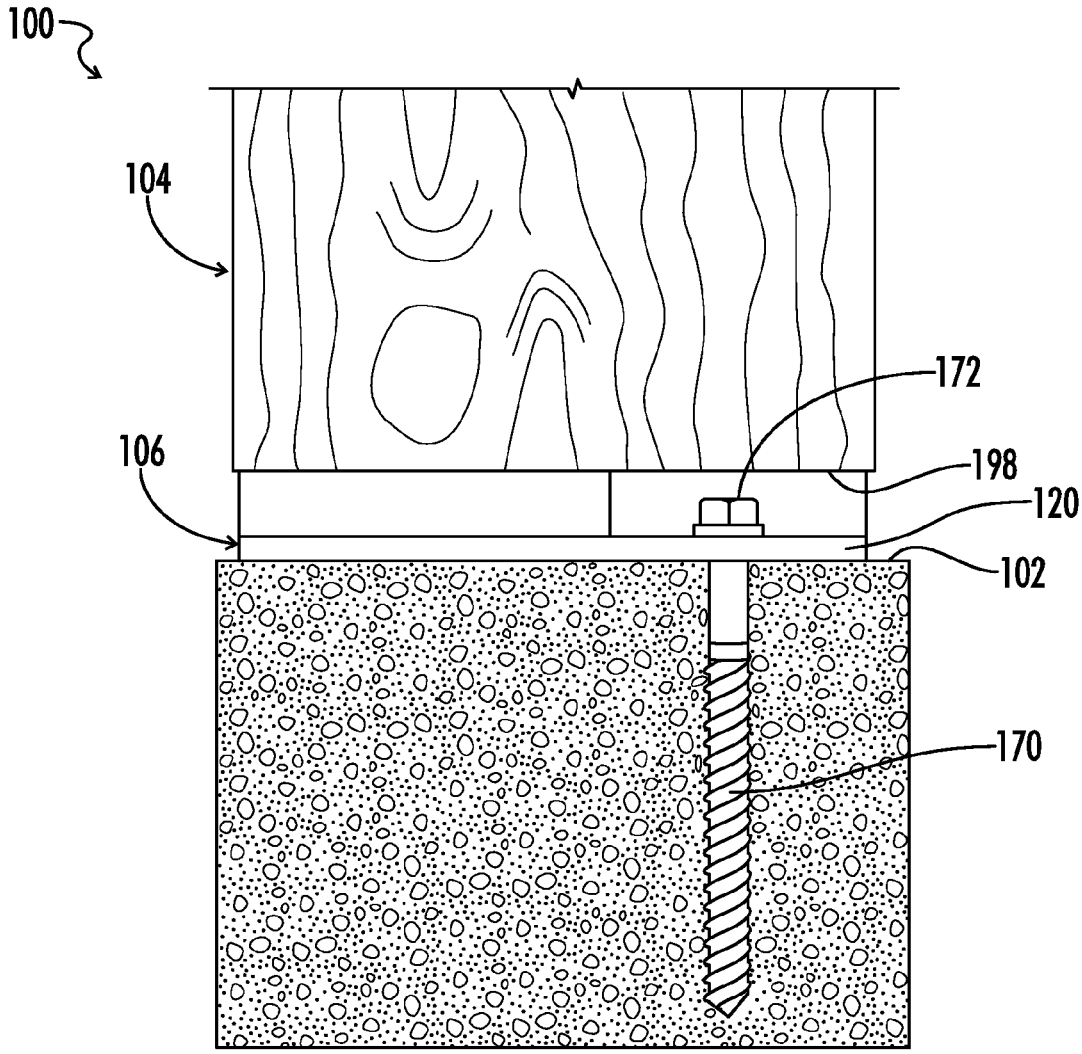
FIG. 3 is a cutaway side view of a post anchor system connecting a hollow core post to a surface.
Figure 4:
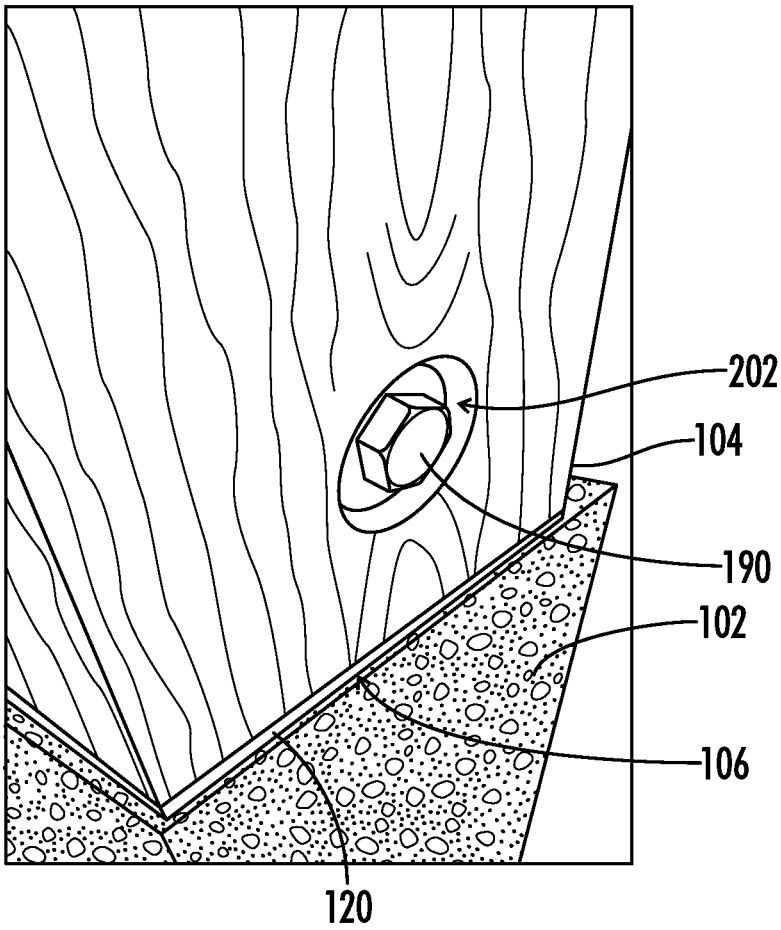
FIG. 4 is an isometric view of a post anchor system connecting a hollow core post to a surface.
Figure 5:
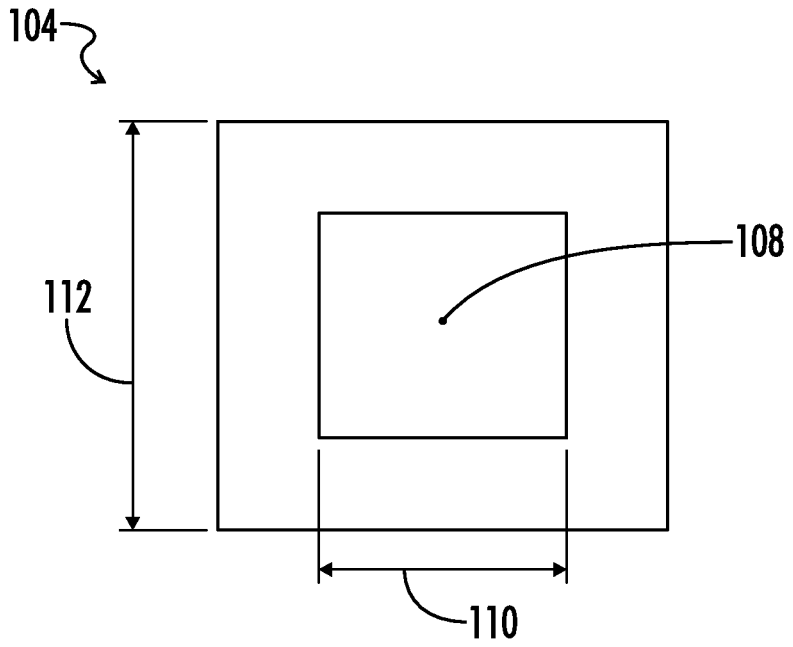
FIG. 5 is a cross-section of a hollow core post.

The post mounting protrusion 122 extends along a second longitudinal axis 140 (see FIG. 2). The post mounting protrusion 122 is affixed to a first face 128 of the base plate 120 such that the second longitudinal axis 140 is substantially perpendicular to the plane defined by the base plate 120. In one embodiment, the post mounting protrusion 122 is substantially tubular or hollow. The post mounting protrusion 122 has an internal passage 160 that extends along the second longitudinal axis 140, and the base plate 120 has a corresponding drainage hole 162 that corresponds to the internal passage 160 of the post mounting protrusion 122. In one embodiment, the post mounting protrusion 122 further includes a post mounting hole 180 extending therethrough and the post anchor system 100 further includes a carriage bolt 190. The post mounting hole 180 is substantially perpendicular to the second longitudinal axis 140, and the post mounting hole 180 is operable to receive the carriage bolt 190. In one embodiment, a cross section of the post mounting protrusion 122 taken perpendicular to the second longitudinal axis 140 is substantially rectangular and has an exterior dimension 192 approximately the same as the internal dimension 110 of the cross-section of the hollow core post 104.

The first stabilizing support 124 is affixed to the first face 128 of the base plate 120. The first stabilizing support 124 extends substantially perpendicularly from the plane defined by the base plate 120. The second stabilizing support is also affixed to the first face 128 of the base plate and extends substantially perpendicularly from the plane defined by the base plate 120. The first stabilizing support 124 is at a third corner 150 of the four corners of the base plate 120. The second stabilizing support 126 is at a fourth corner 152 of the four corners of the base plate 120. The third corner 150 is opposite the fourth corner 152 of the base plate 120. The first stabilizing support 124 extends along two adjacent edges of the four edges of the base plate 120. The second stabilizing support extends along the other two edges of the base plate

120. In one embodiment, the first stabilizing support 124 and the second stabilizing support 126 are L-shaped. In one embodiment, the first stabilizing support 124 and the second stabilizing support 126 extend from the first face 128 of the base plate 120 a substantially constant distance to provide a flat support face for an end 198 of the hollow core post 104 to contact when the post anchor 106 is attached to the hollow core post 104 and the surface 102.

In one embodiment, the post anchor system 100 further includes a first lag screw 170 and a second lag screw. The first mounting hole 130 is operable to receive the first lag screw 170. The second mounting hole 132 is operable to receive the second lag screw. The first lag screw 170 has a head 172, and the second lag screw also has a head. The first stabilizing support 124 and the second stabilizing support 126 are configured to extend further from the base plate than the heads of the first and second lag screws. In one embodiment, the first lag screw 170 and the second lag screw are concrete anchors.

In one embodiment, the post anchor 106 is made of metal. The post anchor 106 may be made, for example, of quarter inch steel. The post mounting protrusion 122, the first stabilizing support 124, and the second stabilizing support 126 are welded to the base plate 120.

A method of anchoring the hollow core post 104 to the surface 102 includes drilling a first concrete anchor pilot hole into the surface 102. A second concrete anchor pilot hole is then drilled into the surface 102. A first concrete anchor 170 is screwed through the first mounting hole 130 in the base plate 120 of the post anchor 106 into the first concrete anchor pilot hole in the surface 102. A second concrete anchor is then screwed through the second mounting hole 132 in the base plate 120 of the post anchor 106 into the second concrete anchor pilot hole in the surface 102. This affixes the post anchor 106 to the surface 102. At least one countersink recess 202 is bored into the side of the hollow core post 104 to align with the post mounting hole 180 in the post mounting protrusion 122 of the post anchor 106 when the end 198 of the hollow core post 104 is in contact with the first stabilizing support 124 and the second stabilizing support 126 of the posting 106. The hollow core post 104 extends along the first longitudinal axis 108 and the post mounting protrusion extends along a second longitudinal axis 140. The hollow core post 104 is positioned on the post mounting protrusion 122 of the post anchor 106 such that the first longitudinal axis 108 is substantially co-linear and coextensive with the second longitudinal axis 140 and the end 198 of the hollow core post 104 is in contact with the first stabilizing support 124 and the second stabilizing support 126 of the post anchor 106. The carriage bolts 190 positioned in the board countersink recess 202 and through the post mounting hole 180 in the post mounting protrusion 122 to secure the hollow core post 104 to the post anchor 106. Tightening a nut onto the carriage bolt 190 completes the insulation.

In one embodiment, the post anchor 106 fits completely within the footprint of the hollow core post 104 such that the post anchor 106 does not need to be concealed by trim in a finished space. Additionally, because the carriage bolt 202 is contained within the footprint of the hollow core post 104, framing may be directly nailed to the hollow core post 104. The first stabilizing support 124, and the second stabilizing support 126 cooperate to provide a stable point load that elevates the end 198 of the hollow core post 104 out of any standing water on the surface 102. This reduces the susceptibility of the installation to rot of the wood in the hollow core post 104.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful HOLLOW CORE POST ANCHOR it is not intended that such references be construed as limitations upon the scope of this invention except as set forth in the following claims.

What is claimed is:

1. A post anchor system comprising:

a surface;

a hollow core post extending along a first longitudinal axis, wherein a cross section of the hollow core post perpendicular to the first longitudinal axis has an internal dimension and an external dimension and the hollow core post has an end;

a post anchor operable to attach to the hollow core post and the surface, said post anchor comprising:

a base plate, wherein:

the base plate defines a plane;

the base plate has a substantially rectangular footprint such that the base plate has four corners and four sides;

the base plate has a first mounting hole therethrough;

the base plate has a second mounting hole therethrough;

the first mounting hole is adjacent a first corner of the four corners of the base plate;

the second mounting hole is adjacent a second corner of the four corners of the base plate, and the first corner is opposite the second corner;

a post mounting protrusion extending along a second longitudinal axis, wherein the post mounting protrusion is affixed to a first face of the base plate and the second longitudinal axis is substantially perpendicular to the plane defined by the base plate; wherein the post mounting protrusion further comprises a post mounting hole extending therethrough;

a first stabilizing support affixed to the first face of the base plate and extending substantially perpendicularly from the plane defined by the base plate, wherein the first stabilizing support is configured to contact and support the end of the hollow core post when the hollow core post is attached to the post anchor; and a second stabilizing support affixed to the first face of the base plate and extending substantially perpendicularly from the plane defined by the base plate, wherein the second stabilizing support is configured to contact and support the end of the hollow core post when the hollow core post is attached to the post anchor.

2. The post anchor system of claim 1, wherein:

the first stabilizing support is at a third corner of the four corners of the base plate;

the second stabilizing support is at a fourth corner of the four corners of the base plate; and the third corner is opposite the fourth corner of the base plate.

3. The post anchor system of claim 1, wherein the first stabilizing support extends along two adjacent edges of the four edges of the base plate and the second stabilizing support extends along the other two edges of the base plate.

4. The post anchor system of claim 1, wherein when the hollow core post is attached to the post anchor, the first longitudinal axis is substantially coextensive with the second longitudinal axis.

5. The post anchor system of claim 1, wherein the post mounting protrusion has an internal passage extending along the second longitudinal axis and the base plate has a drainage hole that corresponds to the internal passage of the post mounting protrusion.

6. The post anchor system of claim 1, further comprising a first lag screw and a second lag screw, wherein:

the first mounting hole is operable to receive the first lag screw;

the second mounting hole is operable to receive the second lag screw;

the first lag screw has a head;

the second lag screw has a head;

the first stabilizing support and the second stabilizing support are configured to extend further from the base plate than the heads of the first and second lag screws;

the first lag screw is a concrete anchor; and the second lag screw is a concrete anchor.

7. The post anchor system of claim 1, wherein the post mounting hole is substantially perpendicular to the second longitudinal axis and the post mounting hole is operable to receive a carriage bolt, and wherein the post anchor system further comprises the carriage bolt.

8. The post anchor system of claim 1, wherein:

a cross section of the post mounting protrusion taken perpendicular to the second longitudinal axis has an exterior dimension approximately the same as the internal dimension of the cross section of the hollow core post; and the base plate has an exterior dimension along the four edges approximately the same as the external dimension of the cross section of the hollow core post.

9. The post anchor system of claim 1, wherein:

the surface is a concrete pier or slab;

the post anchor is metal;

the post mounting protrusion, first stabilizing support, and second stabilizing support are welded to the base plate;

the first stabilizing support and second stabilizing support are L-shaped; and the first stabilizing support and second stabilizing support extend from the first face of the base plate a substantially constant distance to provide a flat support face for the end of the hollow core post to contact when the post anchor is attached to the hollow core post and the surface.

* * * * *